US005112046A

United States Patent [19]

Thorpe

[11] Patent Number: 5,112,046

[45] Date of Patent: May 12, 1992

[54] BILLIARD CUE DEVICE

[76] Inventor: James F. Thorpe, 15830½ N St., Mojave, Calif. 93501

[21] Appl. No.: 668,231

[22] Filed: Mar. 12, 1991

[51] Int. Cl.[5] ..... A63D 15/08

[52] U.S. Cl. ..... 273/68

[58] Field of Search ..... 273/68, 72, 80 R, 80 A, 273/80 D, 80 B, 735, 82 R, 84, 67; 135/65; 280/820, 823

[56] References Cited

U.S. PATENT DOCUMENTS

| | | | |
|---|---|---|---|
| 1,535,667 | 4/1925 | Home | 273/80 R |
| 3,232,613 | 2/1966 | Laube | 273/68 |
| 3,368,271 | 2/1968 | Scheffler | 273/68 |
| 3,469,338 | 9/1969 | Hills | 273/80 R |
| 4,231,574 | 11/1980 | Williams | 273/68 |

FOREIGN PATENT DOCUMENTS

| | | | |
|---|---|---|---|
| 726578 | 1/1966 | Canada | 273/68 |
| 3613131 | 10/1987 | Fed. Rep. of Germany | 273/68 |
| 421212 | 5/1947 | Italy | 273/68 |
| 16785 | 4/1984 | Japan | 273/80 R |
| 1261541 | 1/1972 | United Kingdom | 273/80 R |
| 2096470 | 10/1982 | United Kingdom | 273/68 |
| 2187646 | 9/1987 | United Kingdom | 273/68 |
| 2209681 | 5/1989 | United Kingdom | 273/68 |

*Primary Examiner*—Edward M. Coven
*Assistant Examiner*—Mark S. Graham
*Attorney, Agent, or Firm*—Leon Gilden

[57] ABSTRACT

A billiard cue is formed with a forward section securably mounted to a rear section. The rear and forward sections are formed of an epoxy resin body, including a central carbon graphite core. The apparatus is arranged to accommodate flexure and impact by utilizing elongate carbon filaments directed throughout the forward and rear sections.

2 Claims, 4 Drawing Sheets

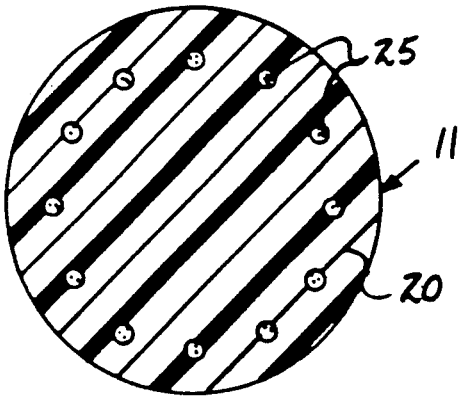
FIG 3
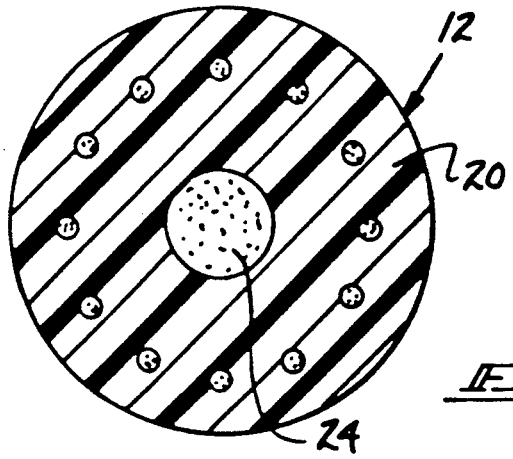
FIG 4
FIG 5
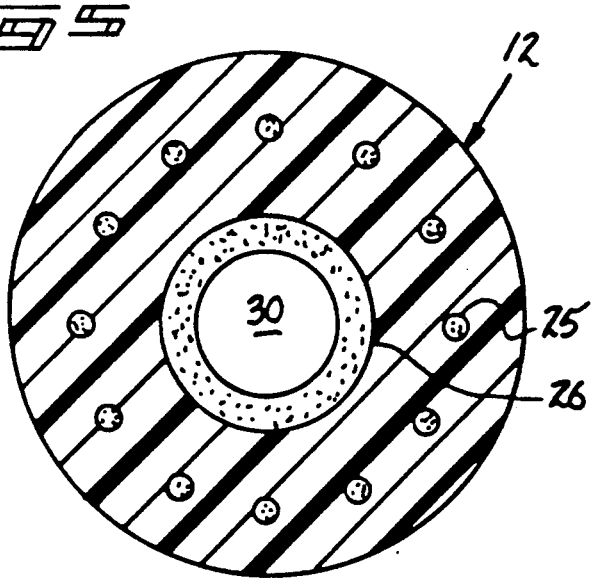

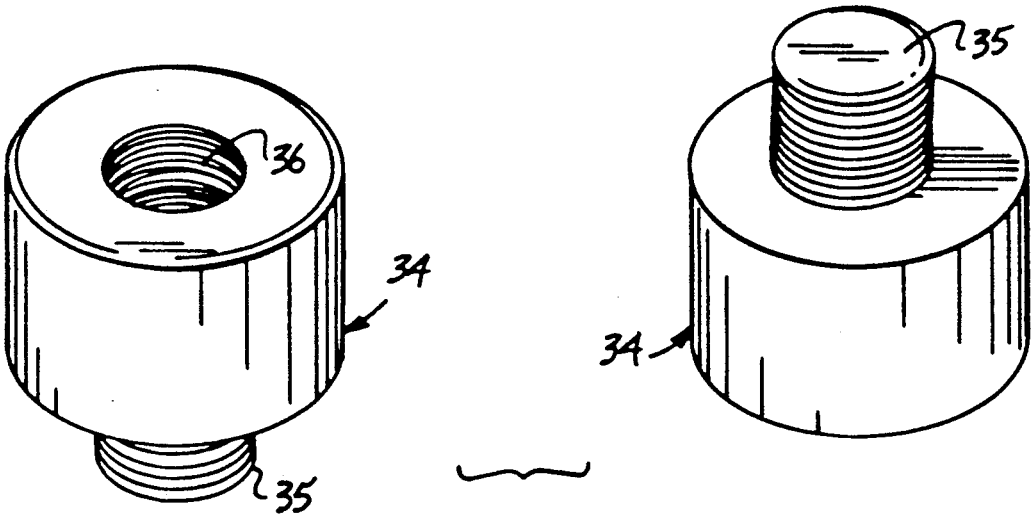
Fig 7
Fig 6
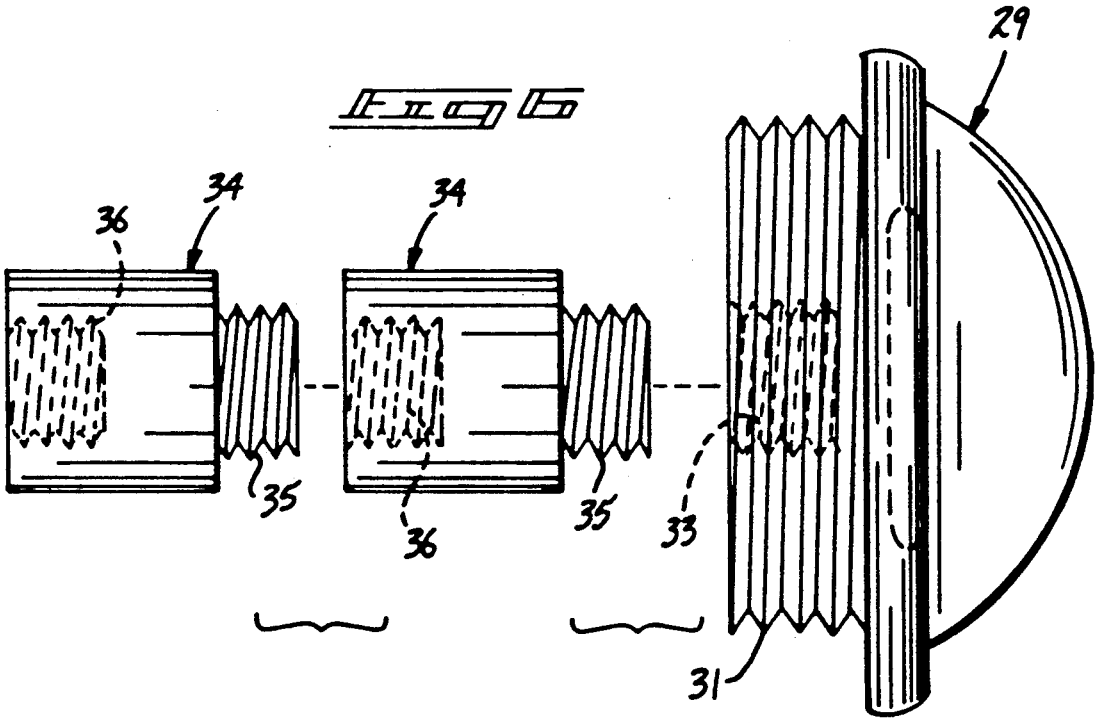

BILLIARD CUE DEVICE

BACKGROUND OF THE INVENTION

1. Field of the Invention

The field of invention relates to billiard cue devices, and more particularly pertains to a new and improved billiard cue device wherein the same includes a carbon graphite construction to accommodate flexure and impact for enhanced longevity of the device.

2. Description of the Prior Art

Billiard cues of various types and configurations have been utilized in the prior art accommodate games such as billiards. The construction of such cues is critical in maintaining axial alignment of the cues for enhanced play and accuracy in their use. Examples of the prior art include U.S. Pat. No. 4,816,203 to Son-Kung wherein a plastic billiard cue includes fiber reinforcing therethrough.

U.S. Pat. No. 4,231,574 to Williams sets forth a billiard cue utilizing a quick disconnect handle between a forward and rear section.

U.S. Pat. No. 3,468,538 to Johnson sets forth a billiard cue utilizing a central core formed with weighted member in a single unitary construction.

U.S. Pat. No. 3,692,609 to Eckes sets forth a method of producing a billiard cue utilizing a plastic core.

U.S. Pat. No. 4,858,926 to Cabianca sets forth a billiard cue organization, including a disassemblable hand grip.

Accordingly, it may be appreciated that there continues to be a need for a new and improved billiard cue device as set forth by the instant invention which addresses both the problems of ease of use as well as effectiveness in construction in providing an easily assembled organization providing enhanced ability to accommodate flexure and impact for prolonged use in maintaining axial alignment of the device.

SUMMARY OF THE INVENTION

In view of the foregoing disadvantages inherent in the known types of billiard cue organizations now present in the prior art, the present invention provides a billiard cue device wherein the same utilizes a carbon core organization to accommodate flexure and impact of the organization in use to maintain axial alignment of the billiard cue. As such, the general purpose of the present invention, which will be described subsequently in greater detail, is to provide a new and improved billiard cue device which has all the advantages of the prior art billiard cue organizations and none of the disadvantages.

To attain this, the present invention provides a billiard cue formed with a forward section securably mounted to a rear section. The rear and forward sections are formed of an epoxy resin body, including a central carbon graphite core. The apparatus is arranged to accommodate flexure and impact by utilizing elongate carbon filaments directed throughout the forward and rear sections.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved billiard cue device which has all the advantages of the prior art billiard cue organizations and none of the disadvantages.

It is another object of the present invention to provide a new and improved billiard cue device which may be easily and efficiently manufactured and marketed.

It is a further object of the present invention to provide a new and improved billiard cue device which is of a durable and reliable construction.

An even further object of the present invention is to provide a new and improved billiard cue device which is susceptible of a low cost of manufacture with regard to both materials and labor, and which accordingly is then susceptible of low prices of sale to the consuming public, thereby making such billiard cue devices economically available to the buying public.

Still yet another object of the present invention is to provide a new and improved billiard cue device which provides in the apparatuses and methods of the prior art some of the advantages thereof, while simultaneously overcoming some of the disadvantages normally associated therewith.

Still another object of the present invention is to provide a new and improved billiard cue device wherein the same utilizes a central carbon core in an epoxy resin utilizing carbon filaments for enhanced stability of the organization to accommodate flexure and impact.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic view, taken along the lines 4—4 of FIG. 1 in the direction indicated by the arrows.

FIG. 5 is an orthographic view, taken along the lines 5—5 of FIG. 1 in the direction indicated by the arrows.

FIG. 6 is an orthographic exploded side view of the cue tip and associated weighted members utilized by the instant invention.

FIG. 7 is an isometric illustration in detail of the weight members utilized by the instant invention.

DESCRIPTION OF THE PREFERRED EMBODIMENT

Figure 1:
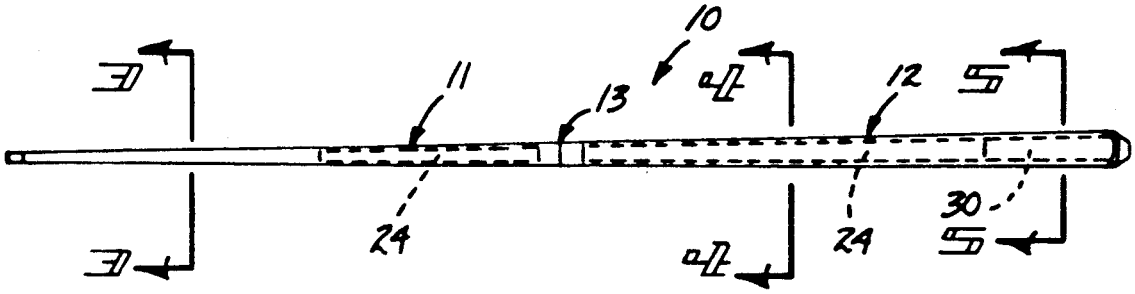
FIG. 1 is an orthographic side view of the instant invention.
Figure 2:
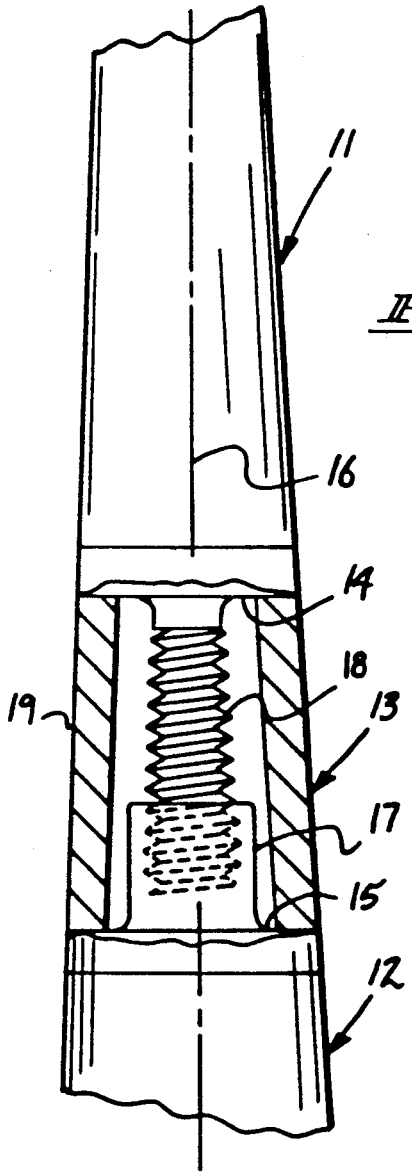
FIG. 2 is an orthographic view, partially in section, of the connection portion of the instant invention.

With reference now to the drawings, and in particular to FIGS. 1 to 8 thereof, a new and improved billiard cue device embodying the principles and concepts of the present invention and generally designated by the reference numeral 10 will be described.

Figure 8:
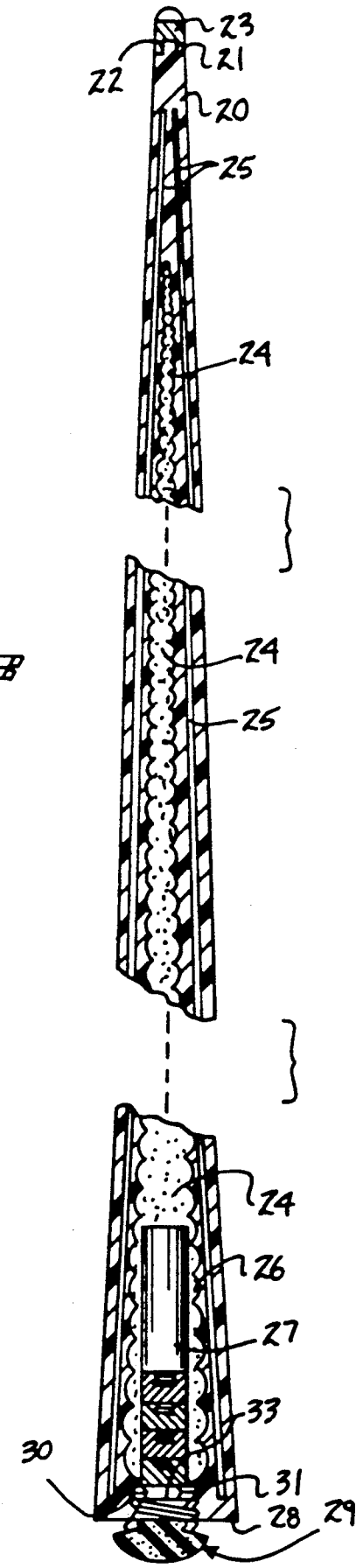
FIG. 8 is an orthographic cross-sectional illustration of the billiard cue and its construction.

More specifically, the billiard cue device 10 of the instant invention essentially comprises a billiard cue, as illustrated in FIG. 1 for example, that is formed with a forward section 11 defined by a truncated conical configuration removably mounted to a rear section 12 defined by a further truncated conical configuration, wherein the forward and rear sections 11 and 12 are securable together by a connector member 13. The billiard cue is defined along a common axis 16 that is coincident with the forward and rear sections 11 and 12 when secured together. The forward section 11 is further defined by a forward section bottom wall 14 that is orthogonally oriented relative to the axis 16 in confronting relationship to a rear section top wall 15 that is also orthogonally oriented relative to the axis 16, wherein the rear section top wall 15 includes an integral internally threaded boss 17 aligned with the axis 16 to threadedly receive an externally threaded boss 18 orthogonally and integrally mounted to the forward section bottom wall 14. The truncated conical hollow guide bushing 19 is integrally secured in alignment with the exterior wall of the forward section 11 to provide a shield for the boss 18 prior to the forward and rear sections being assembled. The forward section 11 and the rear section 12 include an epoxy resin body 20, wherein the forward section is further defined by a compressed carbon graphite core 24 coaxially aligned with the axis 16 directed coextensively throughout the forward section 11 spaced from the forward end thereof or the forward section top wall 21, in a manner as illustrated in FIG. 8 for example. The compressed carbon graphite core 24 is directed throughout the rear section coaxially aligned with the axis 16 rearwardly to define a compressed carbon graphite tube 26 coextensively directed about a handle bore 27 that is coaxially aligned with the rear section 12 and extends from the rear section bottom wall 28 forwardly a predetermined length, wherein the predetermined length defines the handle bore 27 and the compressed carbon graphite tube 26. An internally threaded tip 23 is threadedly and removably mounted relative to an externally threaded boss 22 orthogonally mounted relative to the forward section top wall 21.

FIGS. 6-8 illustrate the use of the rear tip 29 defined by a semi-spherical rear end portion that is coaxially aligned with the axis 16 and includes a rear tip first externally threaded boss 31 threadedly receivable within the rear section internally threaded bore 30 coaxially aligned with the axis 16. A central boss bore 33 coaxially directed through the externally threaded boss 31 threadedly receives a weighted balance member 34. A plurality of such cylindrical weighted members 34 are selectively receivable within the handle bore 27. Each balance member 34 is defined by a predetermined external diameter substantially equal to a predetermined internal diameter defined by the handle bore 27 to maintain alignment of each of the weighted members within the bore 27. Each balance member 34 includes a balance member threaded boss 35 that is coaxially aligned with the balance member 34 directed through a forward face thereof, wherein a balance member internally threaded bore 36 is coaxially aligned with the boss 35 and the balance member 34 to provide securement of a plurality of balance members 34 in fixed securement relative to one another and to the rear tip externally threaded boss 31 to permit an individual to balance the cue tip according to personal preference.

It should be further noted that the forward section includes the plurality of carbon filaments 25 coextensively directed in surrounding relationship relative to the compressed carbon graphite core and extending beyond and in adjacency to the forward section top wall. Further, the rear section includes the matrix of carbon filaments 25 in surrounding relationship relative to the compressed carbon graphite core 24 and the carbon graphite tube 26 coextensively directed throughout the rear section.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A billiard cue device comprising in combination, a forward section defined by a first truncated conical configuration securably mounted to a rear section defined by a further truncated conical configuration, wherein the forward section and rear sections are coaxially aligned along a common axis when the forward section is secured to the rear section, and the forward section including a forward section top wall and a forward section bottom wall, with the forward section top wall and the forward section bottom walls parallel relative to one another and orthogonally aligned relative to the common axle, and the rear section including a rear section top wall and rear section bottom wall, and the rear section top wall and rear section bottom wall are parallel relative to one another and are orthogonally aligned relative to the common axis, and connector means mounted to the forward section bottom wall and the rear section top wall for selective securement of the forward section to the rear section, and wherein the connector means includes an externally threaded boss coaxially aligned with the common axis integrally and orthogonally mounted to the forward section bottom wall, and an internally threaded boss integrally and orthogonally mounted to the rear section top wall threadedly receiving the externally threaded boss therewithin, and a truncated hollow conical guide bushing fixedly mounted to the forward section bottom wall, wherein the conical guide bushing is of a yet further truncated conical configuration aligned with an exterior surface of the forward section and the rear section when the forward section and rear section are secured together, and wherein the forward section includes a compressed carbon graphite core extending coaxially of the forward section along the common axis and extending from the forward section bottom wall spaced from the forward section top wall, and the rear section including a further compressed carbon graphite core extending from the rear section top wall coaxially thereof along the common axis, wherein the further compressed carbon graphite core includes a compressed carbon graphite tube in surrounding relationship relative to a handle bore extending coaxially along the common axis from the rear section bottom wall along the common axis interiorly of the rear section, wherein the handle bore is defined by a predetermined internal diameter, and a plurality of carbon filaments directed coextensively along the compressed carbon graphite core in the forward section coextensively directed along the carbon graphite core in surrounding relationship thereto, and further carbon filaments are directed in surrounding relationship relative to the further compressed carbon graphite core and the compressed carbon graphite tube coextensively of the rear section.

2. An apparatus as set forth in claim 1 including a rear tip, wherein the rear tip includes a rear tip externally threaded boss, and the rear section includes an internally threaded bore directed interiorly of the rear section along the common axis in confronting relationship with the handle bore, and the rear tip externally threaded boss including a central boss bore, and a cylindrical weighted balance member, wherein the cylindrical weighted balance member is defined by a predetermined external diameter substantially equal to the predetermined internal diameter of the handle bore, and the balance member includes a balance member threaded boss and a balance member internally threaded bore, wherein the balance member threaded boss and the balance member internally threaded bore are coaxially aligned with the cylindrical balance member, and the balance member threaded boss is threadedly received within the central boss bore, and including other balance members of identical configuration to the balance member to permit a plurality of the balance members to be positioned within the handle bore, wherein each of the balance members is defined by the predetermined external diameter.

* * * * *